United States Patent [19]

Kushi et al.

[11] Patent Number: 4,696,275

[45] Date of Patent: Sep. 29, 1987

[54] FUEL INJECTION METHOD AND DEVICE PROVIDING SIMPLE ATMOSPHERIC PRESSURE COMPENSATION FOR ENGINE INCORPORATING OPEN TO ATMOSPHERE FUEL PRESSURE REGULATOR VALVE

[75] Inventors: Naoto Kushi; Hiroshi Okano; Nobuyuki Kobayashi; Naoki Sugita, all of Toyota, Japan

[73] Assignee: Toyota Jidosha Kabushiki Kaisha, Toyota, Japan

[21] Appl. No.: 805,902

[22] Filed: Dec. 6, 1985

[30] Foreign Application Priority Data

Feb. 5, 1985 [JP] Japan ..... 60-020729
Mar. 13, 1985 [JP] Japan ..... 60-049553

[51] Int. Cl.[4] ..... F02D 41/32

[52] U.S. Cl. ..... 123/478; 123/480; 364/431.05

[58] Field of Search ..... 123/480, 486, 478; 364/431.05

[56] References Cited

U.S. PATENT DOCUMENTS

| | | | |
|---|---|---|---|
| 3,460,520 | 8/1969 | Huber | 123/478 |
| 3,960,120 | 6/1976 | Aono et al. | 123/478 |
| 4,212,065 | 7/1980 | Marchak et al. | 123/480 |
| 4,454,852 | 6/1984 | Hasegawa | 123/480 |
| 4,495,921 | 1/1985 | Sawamoto | 123/480 |

FOREIGN PATENT DOCUMENTS

| | | | |
|---|---|---|---|
| 58-85337 | 5/1983 | Japan | 123/486 |

*Primary Examiner*—Andrew M. Dolinar
*Attorney, Agent, or Firm*—Cushman, Darby & Cushman

[57] ABSTRACT

An internal combustion engine has an intake system, a fuel injector for injecting fuel into the intake system, a means for supplying pressurized fuel to the fuel injector, and a means for controlling the pressure difference between the pressurized fuel and the current value of atmospheric pressure to be substantially equal to a determinate value. In this fuel injection method, an actual fuel injection time interval is calculated by determining a basic fuel injection time interval according to engine operational parameters, and subsequently: if the current value of atmospheric pressure is higher than a certain standard value, then a reduction correction amount is applied to the basic fuel injection time interval, to derive the actual fuel injection time interval, but otherwise an increase correction amount is applied. Then the fuel injector is controlled to be open for substantially the actual fuel injection time interval. A device is also disclosed for practicing this method. Optionally, in both the above cases, the absolute value of the correction amount may diminish as the absolute value of the intake system pressure diminishes; and, further, the correction may be performed by multiplying the basic fuel injection time interval by a correction coefficient determined by adding, to the product of a first and a second correction value, a third correction value, the first correction value being a function only to intake system pressure, and the second and third correction values being functions only of ambient atmospheric pressure.

2 Claims, 3 Drawing Figures

FUEL INJECTION METHOD AND DEVICE PROVIDING SIMPLE ATMOSPHERIC PRESSURE COMPENSATION FOR ENGINE INCORPORATING OPEN TO ATMOSPHERE FUEL PRESSURE REGULATOR VALVE

BACKGROUND OF THE INVENTION

The present invention relates to the field of fuel injection systems for internal combustion engines in which the injected fuel is supplied to the intake system of the engine via a fuel injector or injectors, and in particular relates to the field of such fuel injection systems in which the pressure of the fuel supplied to the fuel injector or injectors is controlled by a pressure regulator valve of the so called open to atmosphere type.

The present patent application has been at least partially prepared from material which has been included in Japanese Patent Applications Nos. Sho 60-020729 (1985) and Sho 60-049553 (1985), which were invented by the same inventors as the present patent application, and the present patent application hereby incorporates the text of those Japanese Patent Applications and the claims and the drawings thereof into this specification by reference; copies are appended to this specification.

In a conventional such type of fuel injection system for an internal combustion engine such as an automobile engine, such as the so called D jetronic fuel injection system, liquid fuel (i.e. gasoline) is pumped up from a fuel tank and is pressurized by a fuel pump, being then supplied to one or more fuel injectors fitted to the intake system of the engine. A control device opens and closes this injector (hereinafter in this specification the question of possibly plural injectors will be disregarded) with a certain timing, and thereby fuel is supplied into said intake system for the engine, to be sucked into the cylinders and combusted. The control system for this fuel injection system controls the amount of supplied fuel by varying the length of the time interval between the opening of the fuel injection valve and the closing thereof.

The amount of fuel supplied in one fuel injection spurt through the fuel injector can only be satisfactorily controlled by varying the length of the time interval between the opening of the fuel injection valve and the closing thereof, if the rate of flow of fuel through the fuel injector when it is open is substantially constant. Now, this rate of flow is substantially determined, in terms of a constant and unaltered construction for the fuel injector, by the pressure gradient thereacross, in other words by the difference between the absolute pressure value at which is maintained the fuel which is being fed to the fuel injector, and the absolute pressure value which is maintained within the intake system of the engine, near the nozzle of the fuel injector. Thus, provided that this pressure gradient across the fuel injector can be kept substantially constant, the amount of fuel supplied in one fuel injection spurt through the fuel injector is substantially proportional to the time interval that said fuel injector is open. Now, the pressure at which the fuel which is being fed to the fuel injector is maintained, which of course primarily is produced by the pressure due to atmospheric pressure plus the pressure due to the pumping effect of the fuel pump, is typically controlled by a pressure control valve. Therefore, in the prior art, in order to maintain the above described pressure gradient as constant, the pressure in the intake system of the engine has been supplied as a so called background or comparison pressure value to the pressure control valve for the supplied fuel. This pressure control valve has a valve so that it causes a certain determinate pressure value differential to be maintained between said absolute pressure value at which the fuel is being fed to the fuel injector is maintained, and said background absolute pressure value equal to the pressure in the intake system of the engine. This arrangement causes the value of the intake system pressure to be canceled out for determining the pressure gradient across the fuel injector, and also means that the current value of atmospheric pressure is irrelevant to said pressure gradient.

Thus, it is generally the case that:

$$V = C\sqrt{(2g/\gamma)\,(Pf - Pm)} \tag{1}$$

where:

V is the flow rate;

C is the areal coefficient;

g is the acceleration of gravity;

gamma ($\gamma$) is the relative density of the fuel;

Pf is the absolute pressure at the fuel injector; and

Pm is the absolute intake manifold pressure.

Now, if the setting of the pressure control valve for the supplied fuel is equal to Ppr, then Pf=Pm+Ppr, and this reduces to:

$$V = C\sqrt{(2g/\gamma)\,Ppr} \tag{2}$$

and the flow rate through the fuel injector is of course not affected by the current value of the pressure in the intake system or by the current value of atmospheric pressure.

Now, this method and structure are in themselves satisfactory for ensuring that the flow rate through the fuel injector is constant, and accordingly for ensuring that the amount of fuel supplied in one fuel injection spurt through the fuel injector is substantially proportional to the time interval that said fuel injector is open. But, in order to supply the pressure in the intake system of the engine as a background pressure value to the pressure control valve for the supplied fuel, a conduit assembly is needed to conduct said pressure, and connections and fitting for this conduit assembly are required, which is troublesome during manufacture and assembly of the system. Particularly, a takeout port from the engine intake system to supply the pressure therein to the conduit system, such as for example from a surge tank incorporated in said intake system, is required. Further, the positioning of the pressure control valve is restricted by the requirement that it be connected to the conduit system, which is nuisance and leads to design inconvenience.

Another problem that can occur with a conventional fuel injection system in which the pressure of the fuel supplied to the fuel injector is regulated by a pressure regulator valve which is supplied with the pressure in the intake system of the engine as a so called background or comparison pressure value, is that, if said pressure in the intake system drops when the engine is idling, then the fuel pressure correspondingly drops, and this can cause fuel vapor to be introduced into the passages of the system, which can cause vapor lock and rough idling and so on.

SUMMARY OF THE INVENTION

Yet, it will be understood that this requirement for a physical construction to cancel out the effects both of the current value of atmospheric pressure and also of the current value of intake system pressure on the pressure gradient across the fuel injector, is in principle due to a failing of the effectiveness of prior art fuel injection devices and methods. Since a typical control system for a fuel injection system for an internal combustion engine has full control over the opening and the closing of the fuel injector or injectors thereof, such a physical construction should in principle not be necessary.

Also, pressure control valves of the so called open to the atmosphere type are per se known, for which no particular background pressure is required to be supplied, but which control the pressure of a fluid supplied to them merely in relation to the ambient pressure around them, typically atmospheric pressure. These types of pressure control valves tend to be cheaper and easier to install, than the above described types of pressure control valves which require a background pressure to be supplied to them.

Accordingly, it is the primary object of the present invention to provide a fuel injection device for an internal combustion engine, which can utilize a pressure control valve for the liquid fuel supplied to the fuel injector which is of the open to the atmosphere type.

It is a further object of the present invention to provide such a fuel injection device for an internal combustion engine, which can properly control the amount of injected fuel.

It is a further object of the present invention to provide such a fuel injection device for an internal combustion engine, which can properly regulate the amount of injected fuel, without being improperly affected by changing ambient atmospheric pressure.

It is a further object of the present invention to provide such a fuel injection device for an internal combustion engine, which can properly regulate the amount of injected fuel, as the pressure in the intake system of the engine alters.

It is a further object of the present invention to provide such a fuel injection device for an internal combustion engine, which does not require any conduit system for conducting a supply of the pressure in the intake system of the engine to the pressure control valve for the liquid fuel supplied to the fuel injector.

It is a further object of the present invention to provide such a fuel injection device for an internal combustion engine, which does not require any troublesome connections or fitting.

It is a further object of the present invention to provide such a fuel injection device for an internal combustion engine, which does not require any difficult assembly or installation.

It is a further object of the present invention to provide such a fuel injection device for an internal combustion engine, which does not present any design inconvenience.

It is a further object of the present invention to provide such a fuel injection device for an internal combustion engine, in the design of which the position of the pressure control valve for the liquid fuel supplied to the fuel injector is not substantially restricted.

It is a further object of the present invention to provide such a fuel injection device for an internal combustion engine, which is cheap to manufacture and to install.

It is a further object of the present invention to provide such a fuel injection device for an internal combustion engine, which avoids vapor lock.

It is a further object of the present invention to provide such a fuel injection device for an internal combustion engine, which avoids rough engine idle.

It is a further object of the present invention to provide a method of operation, for a fuel injection system for an internal combustion engine, which aids in fulfiling the above detailed objects.

According to the most general method aspect of the present invention, these and other objects are accomplished by, for an internal combustion engine comprising: an intake system; a fuel injector for, according to its opening and closing, injecting fuel into said intake system; a means for supplying pressurized fuel to said fuel injector; and a means for controlling the pressure difference between the pressure of said pressurized fuel which is thus supplied to said fuel injector and the current value of atmospheric pressure to be substantially equal to a determinate value: a method for fuel injection, comprising the steps of: (a) calculating an actual fuel injection time interval by: (a1) determining a basic time interval for fuel injection, according to engine operational parameters; and subsequently: (a2) if the current value of atmospheric pressure is higher than a certain standard atmospheric pressure value, then: (a21) applying a reduction correction amount to said basic fuel injection time interval, to derive said actual fuel injection time interval; but otherwise: (a22) applying an increase correction amount to said basic fuel injection time interval, to derive said actual fuel injection time interval; and: (b) controlling said fuel injector to be open for substantially said actual fuel injection time interval; and, according to the most general device aspect of the present invention, these and other objects are accomplished by, for an internal combustion engine comprising an intake system: a device for fuel injection, comprising: (a) a fuel injector fitted to said intake system for, according to its opening and closing, injecting fuel into said intake system; (b) a means for supplying pressurized due to said fuel injector; (c) a means for controlling the pressure difference between the pressure of said pressurized fuel which is thus supplied to said fuel injector and the current value of atmospheric pressure to be substantially equal to a determinate value: (d) a means for calculating an actual fuel injection time interval by: (d1) determining a basic time interval for fuel injection, according to engine operational parameters; and subsequently: (d2) if the current value of atmospheric pressure is higher than a certain standard atmospheric pressure value, then: (d21) applying a reduction correction amount to said basic fuel injection time interval, to derive said actual fuel injection time interval; but otherwise: (d22) applying an increase correction amount to said basic fuel injection time interval, to derive said actual fuel injection time interval; and: (e) a means for controlling said fuel injector to be open for substantially said actual fuel injection time interval. And, in the case of the above described method, optionally, in either case (a21) or (a22), the absolute value of said correction amount diminishes as the absolute value of the pressure in said intake system diminishes; and, in the case of the above described device, optionally said means for calculating an actual fuel injection time interval, in either case (d21) or (d22), diminishes the absolute value of said correction amount as the absolute value of the pressure in said intake sytem diminishes.

According to such a method and such a structure, since an open to the atmosphere type of pressure regulator valve is typically used as the means for controlling the pressure difference between the pressure Pf of said pressuried fuel which is thus supplied to said fuel injector and the current value of atmospheric pressure to be substantially equal to a determinate value, then in equation (1) above the absolute value of the fuel pressure Pf=Pat+Ppr, where Pat is the current value of atmospheric pressure and Ppr is the constant setting of the pressure regulator valve. In this case, the fuel flow rate V through the fuel injector is given by:

$$V = C\sqrt{(2g/\gamma)\{Ppr + (Pat - Pm)\}} \quad (3)$$

and so is inevitably affected by changes in atmospheric pressure and by changes in the pressure in the intake system of the engine. However, with the present invention, those variations in fuel flow rate through the fuel injector are compensated for by adjusting the fuel injection time. This adjustment is performed, as specified above, after the basic time interval for fuel injection has been determined according to engine operational parameters, by: if the current value of atmospheric pressure is higher than a certain standard atmospheric pressure value, then applying a reduction correction amount to said basic fuel injection time interval, to derive said actual fuel injection time interval; but otherwise applying an increase correction amount to said basic fuel injection time interval, to derive said actual fuel injection time interval. And this application of the increase or decrease correction amount may be performed by multiplication of the basic fuel injection time by a correction coefficient based on the amount of intake air per piston stroke.

The basic fuel injection time described above may be determined by the calculating means either by lookup from a table of values found experimentally or by calculation, according to the values of various engine operational parameters. The basic fuel injection time relates to operation at a standard value of ambient atmospheric pressure. The variations in the flow rate at the injector nozzle are estimated in advance, and fuel injection time amount adjustment is performed when the actual value of the ambient atmospheric pressure is above or below said standard value. Thus, taking this standard atmospheric pressure value as Pas, the correction coefficient Ffp can be expressed as follows:

$$Ffp = \sqrt{\frac{Ppr + (Pas - Pm)}{Ppr + (Pat - Pm)}} \quad (4)$$

Ffp is the flow rate at standard atmospheric pressure, Vs, divided by the flow rate at the current atmospheric pressure, Vr; here Vr is the same as V in equation (3), and Vs is derived by:

$$Vs = C\sqrt{(2g/\gamma)\{Ppr + (Pas - Pm)\}} \quad (5)$$

Thus, equation (4) is derived, and Ffp is found as a function of the atmospheric pressure Pat and the pressure Pm in the intake system of the engine.

If the standard fuel injection time is referred to as TAUs, and the actual fuel injection time as TAUr, then:

$$TAUr = Ffp \cdot TAUs \quad (6)$$

The basic fuel injection times TAUs for various values of the pair of engine operational parameters which are to be used—such as engine rotational speed and intake system pressure, or engine rotational speed and intake flow rate—are found by experiment, and are stored in the ROM of a microcomputer control system for the fuel injection system as a two dimensional data map (or function of two variables which are quantized). These basic fuel injection times TAUs are typically found experimentally on a test bed with a test engine, using an open to the atmosphere type fuel pressure regulator valve of the type specified above at a standard atmospheric pressure, for example one standard atmosphere, and using various different running conditions for said test engine.

Then, the correction coefficient Ffp is determined. In one preferred embodiment of the present invention, this correction coefficient Ffp is determined, likewise, as a two dimensional data map (or function of two variables which are quantized); and the operational parameters of the engine according to which said correction coefficient is determined are intake system pressure and ambient atmospheric pressure. And then the actual fuel injection time is determined by equation (6). In this case, the determination of the correction coefficient Ffp is quick and simple, but a large quantity of memory, i.e. ROM, is required.

As an alternative, given the existence in the system of a powerful arithmetic processor which can operate in real time, it is possible to calculate the correction coefficient Ffp directly in real time (i.e., not using any two dimensional table lookup), according to equation (4) above. This is done by using the values from an atmospheric pressure sensor and from an intake system pressure sensor, constantly operating.

As another alternative, an approximation method can be used, as follows. From equation (5), Ffp is determined as:

$$Ffp = \sqrt{\frac{P_{pr} + (P_{as} - P_m)}{P_{pr} + (P_{at} - P_m)}}$$

$$= \left(1 + \frac{P_{as} - P_{at}}{P_{pr} + (P_{at} - P_m)}\right)^{\frac{1}{2}}$$

and from this, approximately, since $$|(P_{as} - P_{at})/\{P_{pr} + (P_{at} - P_m)\}| < 1$$

we can derive the approximation $$Ffp \approx 1 + \frac{1}{2}\ \frac{P_{as} - P_{at}}{P_{pr} + (P_{at} - P_m)} \quad (7)$$

In this way, only a relatively low power arithmetic processor is required; however, it is still required to be able to perform a division in real time, for determining the value of Ffp. Also, of course, as another alternative, one could store approximation coefficients in a two dimensional map.

In any of these cases, it is seen that according to the present invention there is provided a fuel injection device for an internal combustion engine, which utilizes a pressure control valve for the liquid fuel supplied to the fuel injector which is of the open to the atmosphere type. And this fuel injection device can properly control the amount of injected fuel, without being improperly affected by changing ambient atmospheric pressure, even as the pressure in the intake system of the engine alters. Further, this fuel injection device does not require any conduit system for conducting any supply of the pressure in the intake system of the engine to the pressure control valve, and accordingly does not require any troublesome connections or fitting, or any difficult assembly or installation. Because of the absence of any such conduit system, in the design of this fuel injection device, the position of the pressure control valve is not substantially restricted, and accordingly no substantial design inconvenience is presented. This makes the fuel injection device according to the present invention cheap to manufacture and to install. Also, since no supply of the intake system pressure to the pressure control valve is performed, this system avoids vapor lock and rough engine idle.

Now, the system according to the present invention as explained above requires the sensing of intake system pressure and also of ambient atmospheric pressure. The D jetronic type of fuel injection system in any case has an intake system pressure sensor. And it is possible to employ a dedicated atmospheric pressure sensor; but, as an alternative, by choosing an appropriate time instant at which the intake system pressure is substantially equal to the ambient atmospheric pressure, the reading at this time of the intake system pressure sensor can be used as the value of ambient atmospheric pressure. Such an appropriate time instant may be, for example, when the engine is not running but its starter switch is turned ON, or when a throttle incorporated in the intake system is fully or nearly fully open. In either of these sets of circumstances, the value Pm of the absolute pressure in the intake system approximates to the current value of ambient atmospheric pressure, and can be taken as representative thereof. Since thie value of ambient atmospheric pressure alters relatively slowly, this approximation will not present any problem in practice.

Now, one of the above described preferred embodiments of the present invention requires the use of table lookup for determining the value of the correction coefficient Ffp, another requires the use of a powerful and fast arithmetic processor, and another requires the use of an arithmetic processor which, although not being required to be so fast, still is required to be able to perform a division in real time, for determining the value of Ffp, as per equation (7). But it is a further object of another aspect of the present invention to provide a fuel injection device for an internal combustion engine, which can operate to provide fuel injection in the manner described above, with substantially sufficient accuracy for practical purposes, without requiring the storage of a two dimensional data map for the determination of th correction coefficient Ffp, and without requiring the use oa any particularly powerful arithmetic processor, but just by using a few one dimensional data maps and a simple arithmetic processor; and further to provide a method of operation, for a fuel injection system for an internal combustion engine, which aids in fulfiling the above detailed object.

According to the method aspect of this aspect of the present invention, this and other objects are accomplished by a method for fuel injection as described above, wherein the correction of step (a2) is performed by multiplying the basic fuel injection time interval by a correction coefficient; said correction coefficient being determined by adding, to the product of a first correction value and a second correction value, a third correction value; said first correction value being a function only of intake system pressure; said second correction value being a function only of ambient atmospheric pressure; and said third correction value being a function only of ambiet atmospheric pressure; and, according to the device aspect of this aspect of the present invention, this and other objects are accomplished by a device for fuel injection as described above, wherein the correction of step (d2) is performed by multiplying the basic fuel injection time interval by a correction coefficient; said correction coefficient being determined by adding, to the product of a first correction value and a second correction value, a third correction value; said first correction value being a function only of intake system pressure; said second correction value being a function only of ambient atmospheric pressure; and said third correction value being a function only of ambient atmospheric pressure.

According to such a method and such a structure, three correction values are used, and these are merely multiplied and added together, thus not requiring any real time division process or any high performance type arithmetic processor. Since each of these correction values is a function only of one variable, and may be stored in the memory of the microcomputer as a one dimensional data map, a large quantity of memory is not particularly needed.

The correction function as described above, according to these preferred embodiments, depends upon intake system pressure and also upon atmospheric pressure; but the correction rate according to intake system pressure also depends upon atmospheric pressure, so the correction coefficient is analysed into an atmospheric pressure variation component and an intake system pressure component, and below a certain atmospheric pressure the intake system pressure correction is multiplied by a correction depending upon the atmospheric pressure. Thus, Ffp is calculated from the equation:

$$Ffp=(Fpm\times Fat1)+Fat2$$

Fpm is the first correction coefficient, and is based only upon the intake system pressure. Fat1 is the second correction coefficient, and is based only upon the atmospheric pressure. And Fat2 is the second correction coefficient, and is likewise based only upon the atmospheric pressure. (Fpm×Fat1) is the correction component for intake system pressure, while Fat2 is the correction component for atmospheric pressure.

The basic fuel injection time described above may be determined by the calculating means either by lookup from a table of values found experimentally or by calculation, according to the values of various engine operational parameters. This basic fuel injection time relates to operation at a standard value of ambient atmospheric pressure. The variations in the flow rate at the injector nozzle are estimated in advance, and the correction coefficient Ffp is then unity at standard atmospheric pressure. In this case, the first correction coefficient Ffm is a function of intake system pressure and increases with increasing intake system pressure, while the second correction coefficient Fat1 is a function of atmospheric pressure and decreases with increase in atmospheric pressure, being zero at atmospheric pressure equal to said standard atmospheric pressure, negative at atmospheric pressure above said standard atmospheric pressure, and positive at atmospheric pressure below said standard atmospheric pressure. And the third correction coefficient Fat2 is also a function of atmospheric pressure and decreases with increase in atmospheric pressure, being unity at atmospheric pressure equal to said standard atmospheric pressure, less than unity at atmospheric pressure above said standard atmospheric pressure, and greater than unity at atmospheric pressure below said standard atmospheric pressure.

Also, Ffp can be calculated as:

$$Ffp = 1 + (Fpm \times Fat_1) + Fat_3 \quad (7)$$

In this case, Fat3 is equal to (Fat2−1), and is therefore zero at atmospheric pressure equal to standard atmospheric pressure, positive at atmospheric pressure below standard atmospheric pressure, and negative at atmospheric pressure above standard atmospheric pressure.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENTS

Figure 1:
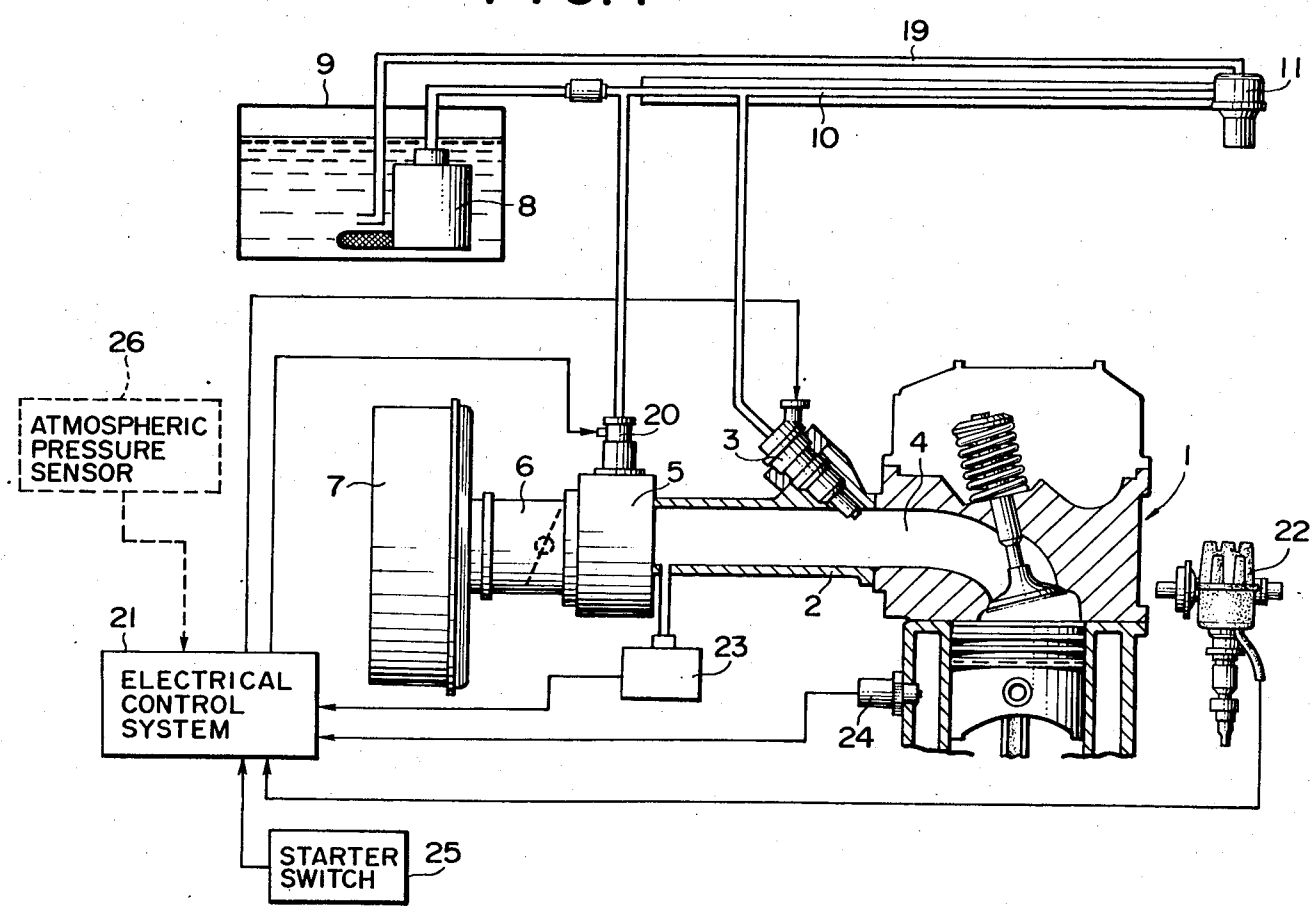
FIG. 1 is a schematic sectional view showing a head portion of an internal combustion engine equipped with an embodiment of the fuel injection device of the present invention for practicing an embodiment of the fuel injection method of the present invention, also showing in block diagram form part of a control system for the fuel injection process; and this figure is applicable to all of the preferred embodiments which will be described.

The present invention will now be described with reference to the preferred embodiments of the method and of the device thereof, and with reference to the appended drawings. FIG. 1 is a schematic sectional view showing a head portion of an internal combustion engine equipped with an embodiment of the fuel injection device of the present invention for practicing an embodiment of the fuel injection method of the present invention (this figure is generic to all of the preferred device and method embodiments); and also shows part of a control system for said fuel injection process, in block diagram form. In this figure, the reference numeral 1 denotes the engine as a whole, and this shown exemplary engine has cyliners, pistons, a cylinder head, and the like which are per se conventional and are not denoted by any reference numerals. The engine 1 has an intake port 4 leading to its intake poppet valve, and an intake manifold 2 is connected to these intake ports 4 to supply intake mixture thereto. A fuel injector 3 is provided for squirting liquid fuel, i.e. gasoline, into the intake manifold 2 near the inlet port 4, and opens and closes according to electrical signals supplied to it, as will be particularly described later. To the upstream end of the intake manifold 2 there is fitted a surge tank 5, which aspirates air through a throttle body 6 within which there is fitted an air throttle, not particularly shown, for controlling the resistance through said throttle body 6 to the flow of air. And to the upstream side of said throttle body 6 there is fitted an air cleaner 7 for the supply of air thereto.

Fuel is stored in a fuel tank 9, and a fuel pump 8 fitted in this fuel tank 9 supplies a pressurized supply of fuel therefrom to a fuel line 10; the pressure in this fuel line 10 is regulated by a pressure regulation valve 11 which will be described in detail shortly, and which vents excess fuel for moderating said pressure in said fuel line 10 back to the fuel tank 9 through a return fuel line 19. Fuel from the fuel line 10 is also supplied to the fuel injector 3 for injection into the intake manifold 2 as described above. Fuel from the fuel line 10 is also supplied to a cold start injector 20 fitted to the surge tank 5, but this is not particularly relevant to the present invention.

Figure 2:
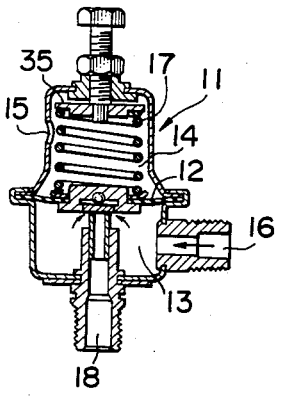
FIG. 2 is a detailed longitudinal sectional view of a fuel pressure control valve of the open to the atmosphere type, as incorporated in all of the preferred device embodiments and as implicated in all of the preferred method embodiments.

The pressure regulator valve 11 is shown in a detailed longitudinal sectional view in FIG. 2, and is of the type which is open to the atmosphere. Again, this figure is generic to all of the preferred device and method embodiments. A pressure adjusting chamber 13 is defined on the lower side of a diaphragm 12 in the figure, and pressurized fuel in the fuel line 10 is supplied to this pressure adjusting chamber 13 through a port 16. On the upper side in the figure of the diaphragm 12 there is defined a background pressure chamber 14 which is communicated to the atmosphere through a vent 15. A compression coil spring 17, the spring force of which is regulated by an adjusting construction 35 which regulates the position of its upper end in the figure, is mounted in the background pressure chamber 14 so as to bias the diaphragm 12 downwards in the figure, so as to press its lower side against the upper end of a fuel return port 18 which opens in the pressure adjusting chamber 13 and which leads to the previously mentioned return fuel line 19, and so as to close off said upper end of said fuel return port 18. Thus, when the pressure of the fuel supplied by the fuel pump 8 to the fuel line 10 and thence to the pressure adjusting chamber 13 is greater than the current value of atmospheric pressure by less than an amount determined by force of the compression coil spring 17 according to the adjusted position of the adjusting construction 35, then said diaphragm 12 remains in its downwardly displaced position as seen in the figure, and said upper end of said fuel return port 18 remains closed off thereby, and thus said pressure in said fuel line 10 is not interfered with; but on the other hand, when the pressure of the fuel supplied by the fuel pump 8 to the fuel line 10 and thence to the pressure adjusting chamber 13 rises to become greater than the current value of atmospheric pressure by more than said determinate amount, then said diaphragm 12 is displaced to its upwardly displaced position as seen in the figure, and said upper end of said fuel return port 18 now becomes opened, thus communicating said pressure adjusting chamber 13 with the fuel return port and allowing the pressure in the fuel line 10 to be vented back to the fuel tank 9 through the return fuel line 19, which is substantially at ambient or atmospheric pressure. Thereby, this pressure regulator valve 11 regulates the pressure of the fuel in the fuel line 10 to be a determinate amount higher than the current valve of atmospheric pressure. In terms of absolute pressure values, the regulated value of the absolute pressure of the fuel in the fuel line 10 is thus dependent upon atmospheric pressure, and if the current value of atmospheric pressure drops, then the absolute value of the pressure of the fuel in said fuel line 10 also drops.

The operation of the fuel injector 3 and the cold start injector 20 (as well as that of the fuel pump 8) is controlled by an electrical control system 21 incorporating a microcomputer. This electrical control system 21 receives input data from various sensors and the like, including but not limited to: an engine rotational speed sensor 22 fitted to the distributor of the engine 1; an intake manifold pressure sensor 23 fitted to the intake manifold 2; an engine water temperature sensor 24 fitted to the water jacket of the engine 1; a starter switch 25 of the engine 1. Further, the control system 21 may optionally receive a signal representative of the current value of atmospheric pressure from an atmospheric pressure sensor 26; because this sensor is not essential for the present invention but only optional, it is shown in FIG. 1 by dashed lines. It should be particularly noted that the intake manifold pressure sensor 23 fitted to the intake manifold 2 produces an output signal which is representative of the absolute value of the pressure in said intake manifold 2, not of the relative value of said pressure as compared to the current value of atmospheric pressure. The microcomputer incorporated in the control system 21 is of a per se known type, comprising a RAM (random access memory), a ROM (read only memory), and so on.

In the ROM of this microcomputer incorporated in the control system 21 there are stored data for the basic fuel injection time TAUs at atmospheric pressure determined by estimating changes in the fuel flow rate through the fuel injector 3 caused by variations in the intake manifold pressure due to variations in the load on the engine 1, in the form of a two dimensional data map as a function of engine rotational speed (as determined by the engine rotational speed sensor 22) and absolute intake manifold pressure (as determined by the intake manifold pressure sensor 23). Thus, during operation, the program in the microcomputer uses the values of the output signal of said engine rotational speed sensor 22 and the output signal of said intake manifold pressure sensor 23 (of course as processed by some form of A/D converter) to index said two dimensional data map and to find the appropriate value of the basic fuel injection time TAUs. Next, said program determines the value of a correction coefficient Ffp, in a manner specific to each of the preferred embodiments of the method and device according to the present invention as will be explained in greater detail later, and multiplies the basic fuel injection time TAUs by this correction coefficient Ffp, to obtain an actual time TAUr for fuel injection. However, it is not excluded that, in addition to the multiplication of the basic fuel injection time TAUs by the correction coefficient Ffp, the derivation of this actual fuel injection time TAUr might not include further correction activity, as for example the application of addition or multiplication corrections dependent upon engine water temperature or upon other conditions.

So far, the details explained of the fuel injection method and device of the present invention have been applicable to all of the preferred embodiments thereof which will be disclosed herein. What now folows, however, will be specific to the particular embodiments.

Figure 3:
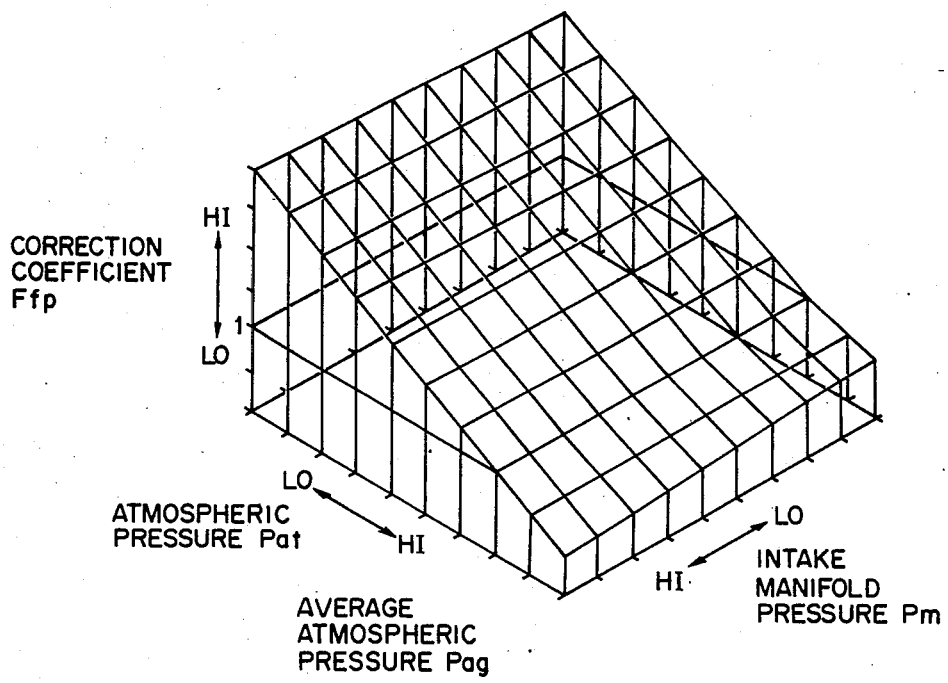
FIG. 3 schematically shows in perspective view a two dimensional data map applicable to the first preferred embodiments of the device and the method of the present invention, said data map being stored in the ROM (read only memory) of a microcomputer incorporated in the FIG. 1 engine and relating the value of a correction coefficient Ffp for the time for fuel injection to the current value Pat of atmospheric pressure and also to the current value Pm of the pressure in the intake manifold of said FIG. 1 engine.

In the first preferred embodiment of the fuel injection device of the present invention, which practices the first preferred embodiment of the fuel injection method of the present invention, the microcomputer incorporated in the control system 21 determines the value of the correction coefficient Ffp for the fuel injection time from a two dimensional data map stored in the ROM of said microcomputer, as schematically illustrated in FIG. 3. This two dimensional data map indexes the value of the correction coefficient Ffp against the current value Pat of atmospheric pressure and the current value Pm of the absolute pressure in the intake manifold 2 of the engine 1. The current value Pm of the absolute pressure in the intake manifold 2 is of course determined, as described above, according to the output signal of the intake manifold pressure sensor 23. As for the current value Pat of atmospheric pressure, it may be derived according to the output signal of an atmospheric pressure sensor 26, if one is in fact fitted to the internal combustion engine 1 as schematically shown by the dashed lines in FIG. 1, which is the more accurate but more expensive method. Alternatively, since in the D jetronic fuel injection system the intake manifold pressure sensor 23 is in any case provided, said current value Pat of atmospheric pressure may be derived by using therefor the value Pm of the absolute pressure in the intake manifold 2, when last the conditions were suitable for such a determination, as for example when last the engine 1 was not running but the starter switch 25 was truned ON, or when last the throttle incorporated in the throttle block 5 was fully or nearly fully open. In either of these sets of circumstances, the value Pm of the absolute pressure in the intake manifold 2 approximates to the current value of ambient atmospheric pressure, and can be taken as representative thereof. Since the value of ambient atmospheric pressure alters relatively slowly, this approximation will not present any problem in practic.

Thus, as suggested in FIG. 3: when the current value pat of atmospheric pressure is substantially equal to the standard or average atmospheric pressure value Pag for which the values of the basic fuel injection time TAUs were determined, then naturally the value of the correction coefficient Ffp for the fuel injection time is unity, whatever may be the value Pm of the absolute pressure in the intake manifold 2. If, on the other hand, the current value Pat of atmospheric pressure is substantially greater than said standard or average atmospheric pressure value Pag for which the values of the basic fuel injection time TAUs were determined, then the value of the correction coefficient Ffp for the fuel injection time is less than unity, and becomes closer to unity, i.e. increases so that the correction amount decreases, the lower becomes the value Pm of the absolute pressure in the intake manifold 2. And if, contrariwise, the current value Pat of atmospheric pressure is substantially less than said standard or average atmospheric pressure value Pag for which the values of the basic fuel injection time TAUs were determined, than the value of the correction coefficient Ffp for the fuel injection time is greater than unity, and becomes closer to unity, i.e. decreases so that the correction amount decreases, the lower becomes the value Pm of the absolute pressure in the intake manifold 2.

When the correction to the basic fuel injection time TAUs is made as described above to derive the actual fuel injection time TAUr, even in the case of using a pressure regulator valve 11 such as of the type shown in FIG. 2 which is of the type which is open to the atmosphere, the amount of injected fuel can be controlled to be correct.

Thus it is seen that according to the present invention there is provided a fuel injection device for an internal combustion engine, which utilizes a pressure control valve for the liquid fuel supplied to the fuel injector which is of the open to the atmosphere type. And this fuel injection device can properly control the amount of injected fuel, without being improperly affected by changing ambient atmospheric pressure, while the pressure in the intake system of the engine alters. Further, this fuel injection device does not require any conduit system for conducting any supply of the pressure in the intake system of the engine to the pressure control valve, and accordingly does not require any troublesome connections or fitting, or any difficult assembly or installation. Because of the absence of any such conduit system, in the design of this fuel injection device the position of the pressure control valve is not substantially restricted, and accordingly no substantial design inconvenience is presented. This makes the fuel injection device according to the present invention cheap to manufacture and to install. Also, since no supply of the intake system pressure to the pressure control valve is performed, this system avoids vapor lock and rough engine idle.

In this first preferred embodiment of the device and the method of the present invention, the data map of FIG. 3 can be derived according to the equation (4) given earlier in this specification.

Alternatively, if the microcomputer incorporated in the control system 21 is provided with a high power real time floating point calculation capability, it is not actually necessary to store the two dimensional data map of FIG. 3 in the ROM of said microcomputer, but Ffp can be calculated on a real time basis, i.e. continuously, according to equation (4) or according to the approximation of equation (7) also given earlier in this specification.

Although the device and the method of the present invention have been described above as applied to an engine incorporating the so called D jetronic method of fuel injection, they need not be limited to this, but may also be applied to an engine incorporating the so called L jetronic method of fuel injection. In such a case, it is only necessary to add an intake manifold pressure sensor (similar to the sensor 23 above) to the usual devices incorporated in such a fuel injection system.

Now, another preferred embodiment of the method and the device of the present invention will be described. This method and device are particularly characterized by, as explained in an earlier portion of this specification, not requiring the storage of a two dimensional data map for the determination of the correction coefficient Ffp, and not requiring the use of any particularly powerful arithmetic processor, but by just using a few one dimensional data maps and a simple arithmetic processor. In fact, in this preferred embodiment, the correction coefficient Ffp is calculated from the equation:

$$Ffp=(Fpm\times Fat1)+Fat2$$

where Fpm, Fat1, and Fat2 are correction coefficients which are functions of one variable, and are thus stored in one dimensional data maps in the ROM of the microcomputer incorporated in the control system 21 in advance. (The derivation of this formula is explained earlier in this specification). In detail: Fpm is a function of the intake system pressure Pm; Fat1 is a function of the ambient atmospheric pressure Pat; and Fat2 is likewise a function of the ambient atmospheric pressure Pat. As before, the current value Pat of atmospheric pressure may be derived by using therefor the value Pm of the absolute pressure in the intake manifold 2 when last the conditions were suitable for such a determination, or alternatively by providing a dedicated ambient atmospheric pressure sensor such as the sensor 26 schematically suggested in FIG. 1 by the dashed lines.

For example, to take the exemplary case of a four stroke gasoline engine relating to which expriments were performed by the present inventors, the setting of the pressure regulator valve 11 was 2.55 kg/cm$^2$ which is equivalent to 1875.68 mmHg, and it was found that it was effective to determine Fpm, Fat1, and Fat2 according to the following tables:

TABLE 1

| Pm | 134 | 213 | 291 | 369 | 447 | 525 | 603 | 681 | 759 |
|---|---|---|---|---|---|---|---|---|---|
| Fpm | 0 | 0.0016 | 0.0032 | 0.0050 | 0.0068 | 0.0088 | 0.0010 | 0.0134 | 0.0160 |

TABLE 2

| Pat | 550 | 650 | 760 | 800 |
|---|---|---|---|---|
| Fat1 | 1 | 0.5 | 0 | −0.16 |

TABLE 3

| Pat | 550 | 650 | 760 | 800 |
|---|---|---|---|---|
| Fat2 | 1.0448 | 1.0227 | 1 | 0.9921 |

Thus, the correction coefficient Ffp is equal to unity at standard atmospheric pressure Pas 760 mmHg, regardless of the intake system pressure Pm, and is less than unity when Pat is greater than Pas and vice versa;

and, when Pat is not equal to Pas, and Pm decreases, Ffp is brought closer to unity, i.e. the correction decreases. When Ffp is determined thus, there is little difference from the exact determination thereof according to equation (4) or equation (7), and the error is found to be within the range of 0.3%, which is an adequate implementation.

By deriving Ffp as above, when Pat is greater than Pas the fuel injection time is reduced, and contrariwise when Pat is greater than Pas the fuel injection time is increased, and in both cases the correction amount is reduced with a decrease in intake system pressure. With this form of correction, even with using pressure regulator valve 11 such as of the type shown in FIG. 2 which is of the type which is open to the atmosphere, the amount of injected fuel can be controlled to be correct, without without requiring the storage of a two dimensional data map for the determination of the correction coefficient Ffp, and without requiring the use of any particularly powerful arithmetic processor, but just by using three one dimensional data maps (the Tables 1, 2, and 3) and a simple arithmetic processor, which needs only to be capable of multiplication, in real time, and not division.

As seen from the exemplary Table 1 and 2, the influence of Fpm×Fat1 is tiny compared to the influence of Fat2, and, if the accuracy of the setting of the pressure regulator valve 11 and of the determination of intake system pressure by the pressure sensor 23 is high this can be treated as a determining element for Ffp, but if the accuracy of these measurements is not high then this correction factor will become meaningless. In any case, since the influence of Fpm×Fat1 is so small, it can actually be ignored in some practical cases, and in such a case Ffp=Fat2, and the microcomputer incorporated in the control system 21 needs only to be provided with one one dimensional data map, for Fat2. This is a further simplification of the principle of the present invention.

As before, the device and the method of the present invention as described above may also be applied to an engine incorporating the so called L jetronic method of fuel injection. In such a case, again, it is only necessary to add an intake manifold pressure sensor to the usual devices incorporated in such a fuel injection system.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A device for fuel injection in an internal combustion engine which has an intake system, comprising:

(a) fuel injector means, fitted to said intake system for injecting fuel into said intake system according to an opening and closing of said fuel injector means;

(b) means for supplying pressurized fuel to said fuel injector means;

(c) means for controlling a pressure difference between a pressure of said pressurized fuel which is supplied to said fuel injector means and a current value of atmospheric pressure to be substantially equal to a determinate value;

(d) means for calculating an actual fuel injection time interval by:

(1) determining a basic time interval for fuel injection, according to engine operational parameters and a certain atmosphere pressure;

(2) if the current value of atmospheric pressure is higher than said certain atmospheric pressure value, then applying a reduction correction amount which decreases said basic fuel injection time interval to said basic fuel injection time interval, to derive said actual fuel injection time interval; and (3) if the current value of atmospheric pressure is not higher than said certain atmospheric pressure, then applying an increase correction amount which has an absolute value that diminishes as the absolute value of the pressure in said intake system diminishes to said basic fuel injection time interval, to derive said actual fuel injection time interval; and said correction amount being determined by multiplying the basic fuel injection time interval by a correction coefficient;

said correction coefficient being determined by adding, to the product of a first correction value and a second correction value, a third correction value;

said first correction value being a function only of intake system pressure;

said second correction value being a function only of ambient atmospheric pressure; and and said third correction value being a function only of ambient atmospheric pressure; and (e) means for controlling said fuel injection means to be open for substantially said actual fuel injection time interval.

2. A device for fuel injection according to claim 1, wherein: said first correction value increases with increasing intake system pressure; said second correction value decreases with increase in atmospheric pressure, being zero at atmospheric pressure equal to a standard atmospheric pressure value, negative at atmospheric pressure above said standard atmospheric pressure value, and positive at atmospheric pressure below said standard atmospheric pressure value; and said third correction value decreases with increase in atmospheric pressure, being unity at atmospheric pressure equal to said standard atmospheric pressure value, less than unity at atmospheric pressure above said standard atmospheric pressure value, and greater than unity at atmospheric pressure below said standard atmospheric pressure value.

* * * * *